United States Patent [19]

Lichtenberger et al.

[11] 4,077,225

[45] Mar. 7, 1978

[54] APPARATUS FOR ICE DISAGGREGATION

[75] Inventors: Gunter J. Lichtenberger; George W. Morgan, both of Dallas, Tex.

[73] Assignee: Sun Oil Company Limited, Toronto, Canada

[21] Appl. No.: 772,792

[22] Filed: Feb. 28, 1977

[51] Int. Cl.[2] ..... E02B 15/02; B63B 35/12

[52] U.S. Cl. ..... 61/103; 61/1 R; 114/42; 175/18; 299/24

[58] Field of Search ..... 61/1 R, 103; 299/24, 299/25, 26; 175/18; 114/42, 40, 41

[56] References Cited

U.S. PATENT DOCUMENTS

| | | | |
|---|---|---|---|
| Re. 28,332 | 2/1975 | Schritzinger | 61/1 R |
| 3,405,527 | 10/1968 | Farr et al. | 61/1 R |
| 3,672,175 | 6/1972 | Mason | 61/1 R |
| 3,696,624 | 10/1972 | Bennett | 61/1 R |

*Primary Examiner*—Paul R. Gilliam
*Assistant Examiner*—Alex Grosz
*Attorney, Agent, or Firm*—J. Edward Hess; Donald R. Johnson; James H. Phillips

[57] ABSTRACT

An ice cutter movably mounted on a marine structure for cutting encroaching ice floes or ice sheets. A cutter blade is mounted on the structure so that it may be conveniently moved into a position on the structure toward which the ice is moving. Acoustical energy is imparted to the cutter blade which in turn is positioned adjacent the encroaching ice and moved relative to the ice in a manner to cut out a path of unconsolidated ice so that the floe may pass the marine structure without applying destructive forces to the structure.

8 Claims, 5 Drawing Figures

APPARATUS FOR ICE DISAGGREGATION

BACKGROUND OF THE INVENTION

This invention relates to an ice cutting system and more particularly to a system for forming a path of unconsolidated ice in an ice floe or ice sheet in order to permit the ice to move relative to a marine structure without applying destructive forces to the structure.

The invention disclosed herein deals with the problem of moving ice encountered in frigid waters such as in the Arctic Ocean. Currently there is considerable activity in these areas directed toward the location and development of sources of petroleum and other natural resources. In the search for petroleum in offshore areas, platforms are typically used to locate equipment and personnel. These platforms are normally maintained in a relatively fixed position with respect to the underwater floor such as by anchoring the platform to the ocean floor or by use of dynamic positioning techniques. In any event, in the normal course of drilling or producing from such a platform into the earth's subsurface, pipes are extended from the platform into the earth's subsurface and it is important to maintain the platform in a relatively fixed position in order to prevent breaking or withdrawing the pipe from the earth's subsurface.

Such platforms, if located in ice covered areas of water, are exposed to ice floes which sometimes float freely on the water and may frequently be of such size that a platform is susceptible to damage or destruction as a result of forces produced by the moving ice. For example, the Arctic Ocean adjacent the North coast of Alaska is characterized by its shallow depth and gradual slope to deep water. Air temperatures usually range from −40° F to +50° F. The water is fairly uniform in temperature, from +28° F to +30° F and very saline. Winds are predominantly from the East, 10 to 15 knots with gusts of 50 to 60 knots. In the months of November through April, large masses of ice, known as ice packs, are in continuous movement under the effects of wind. The huge ice fields are propelled in all directions by the winds and somewhat, although not greatly, by ocean currents.

The main ice formation in the Artic Ocean is an ice sheet which is generally 6 to 10 feet thick. Another form of ice encountered is "rafted" ice which is the term used to describe the overlapping of ice sheets as one sheet rides up over another sheet, resulting in an ice floe made up of two or more distinct layers. However, rafting does not generally take place between sheets of more than 1 or 2 feet in thickness since ice is weak in tension and cannot withstand the deflection necessary for thicker sheets to ride over the other. A more serious hazard is represented by ice ridges which are formed by the motion of ice sheets, and, which can attain, heights in excess of 50 feet. In this regard Arctic ice normally exhibits a compressive strength of 1000–3000 PSI and a tensile strength of 300–1000 PSI depending on various factors. For example, colder and less saline conditions would cause the foregoing strength figures to move toward the higher end of the ranges.

Due to problems inherent to petroleum exploration and production in ice covered regions, considerable effort has been expended toward developing subsea or other alternate systems of operating in such areas. As a result of the high cost of alternative systems coupled with the amount of technical development involved, none to date have become operable. If techniques can be developed to cut ice or otherwise render an unconsolidated path through an ice floe as it moves relative to a more conventional platform, then such conventional offshore systems can be used which are presently available and least expensive in cost.

The amount of ice cutting necessary to prevent damage to a platform from moving ice varies, of course, with changing conditions such as thickness and rate of ice movement. Since the problem of energy supply is extremely critical in arctic operation, minimizing use of energy as for cutting ice is very important. For this reason it would probably be preferable to use a monopod structure to support a platform thereby minimizing the profile subject to ice interference, but multileg platforms may offer other overall advantages and this invention is not limited to any particular type of platform design. In addition, if attention is paid to the size of ice portions being cut or broken from the ice mass, the energy expended in cutting a path through the ice may be minimized. For example, the smaller the particles produced by the cutting process, the higher the energy expended in disaggregating a given volume of it. Furthermore, if ice is shredded or chipped into small particles, it tends to fluff, creating a large volume that, when wetted, tends to freeze, generating an even greater problem. It is preferable to cut the ice into fragments that can be easily moved during ice motion and displaced away from the cutting area such as by fragments piling on top of one another and drifting past a platform or being shoved aside. Therefore, the ideal situation is to cut the largest blocks or fragments that are movable without damage to the structure about which the path is being cut.

In designing a cutting system it is also desirable to minimize maintenance since severe weather conditions make outside maintenance hazardous. A breakdown of such an ice removal system might cause the ice to damage or destroy the platform.

SUMMARY OF THE INVENTION

With these and other objects in view, the present invention relates to the concept of movably mounting a support member on a platform so that it may be positioned relative to changing directions of ice movement and be accessible to the platform for maintenance. An ice cutting edge is mounted on the support member and an acoustic transducer is coupled with the cutting edge. Acoustic energy applied to the cutting edge causes ice in its path to deconsolidate and, as the cutting edge is moved, cuts blocks from the ice.

DETAILED DESCRIPTION

Figure 1:
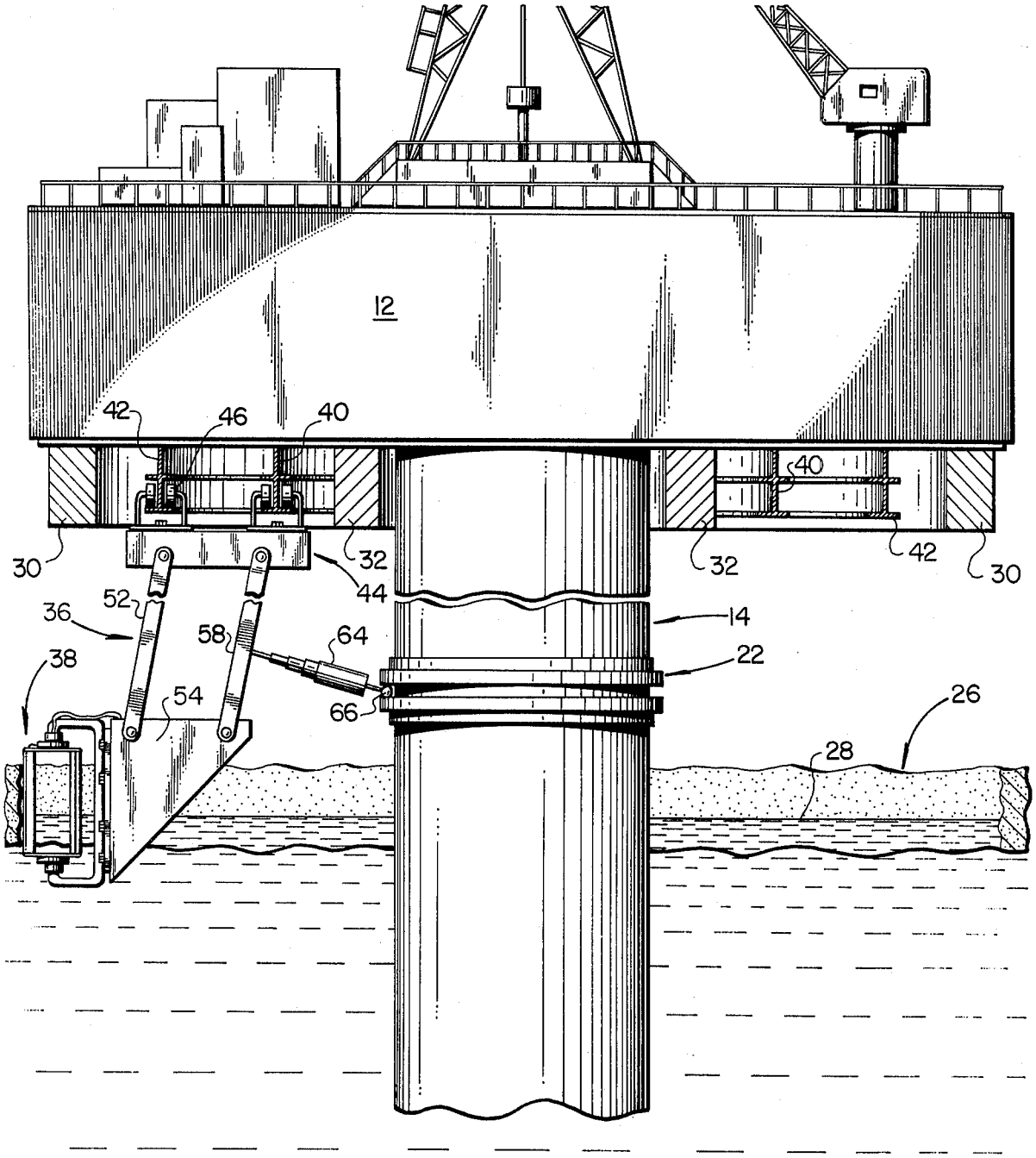
FIG. 1 is an elevational view of an offshore platform leg, which could be the support column for a monopod, equipped with a movable mounting for supporting an ice cutter in accordance with the present invention.

FIG. 1 illustrates an offshore platform 12 resting atop a rigid hollow support member 14 which extends to the floor of a body of water having a water surface 28, with an ice floe 26 floating thereon. Mounted on support member 14 of platform 12 is a sleeve 22 which completely encircles the support member 14 and is constructed in such a manner as to form a race for supporting a movable bearing surface therein. Skirts 30 and 32 are shown extending downwardly from the lower surface of the platform to form a protective area for a support mechanism 36. An ice cutting device 38 is manipulatively supported from the support mechanism.

The support mechanism 36 is comprised of inner and outer rails 40, 42 which depend downwardly from the platform 12 and form a parallel track system for supporting a bridge crane structure or the like 44. Roller assemblies 46 extend upwardly from the bridge crane 44 and are arranged to slidingly engage the rails 40, 42 and thereby provide a means for movably mounting the bridge crane 44 on a circular path for movement about the underside of the platform 12. Although not disclosed in the drawings, the bridge crane 44 can be provided with a rail surface for a transversely moving gantry crane which is likewise mounted by wheels on a rail to provide lateral movement of the crane relative to the support member 14.

A positioning mechanism is mounted from the crane 44 and is arranged to support the cutting device 38 therefrom. The positioning mechanism includes a multi-arm support in the form of a parallelogram (see FIG. 2) having pairs of support arms 52, 58 pivotally attached at their upper end to the crane 44 and at their lower end to a support frame 54. Only one member of each pair of arms 52, 58 is shown in FIG. 1, however, each arm 52, 58 has an identical arm positioned transversely behind it as viewed in FIG. 1 and attached to the other side of frame 54 (see FIG. 2). It is noted that arms 52 are offset outwardly by spacers 50 from arms 58 so that further collapse of the arms is possible when the frame 54 is moved upwardly relative to the platform. A hydraulically actuated extendable boom 64 is shown positioned between the race 22 and a cross member 68 (see FIG. 5) between support arms 58, with boom 64 being operable from the platform to expand and collapse to move the cutting device away from or toward the support member 14. Boom 64 is connected at its outer end to the cross member between arms 58 by means of a pivotal connection and at its inner end to the race 22 by means of a sliding member 66. Sliding member 66 is free to move within the race 22 and together with boom 64 provides lateral support to the positioning and cutting device carried by the previously described crane and support mechanisms. The bucket shaped support frame 54 has holes 60 in its front surface to permit variable mounting of the cutter mechanism mounting plate 62 on the frame by means of bolts or the like. Of course, a hydraulic mechanism, or the like, operable from the platform, could be provided to raise and lower the cutter relative to frame 54. Means not shown are provided on the underside of platform 12 to provide access to the crane and boom mechanisms so that maintenance can be performed within the protective skirts on the underside of the platform.

Figure 2:
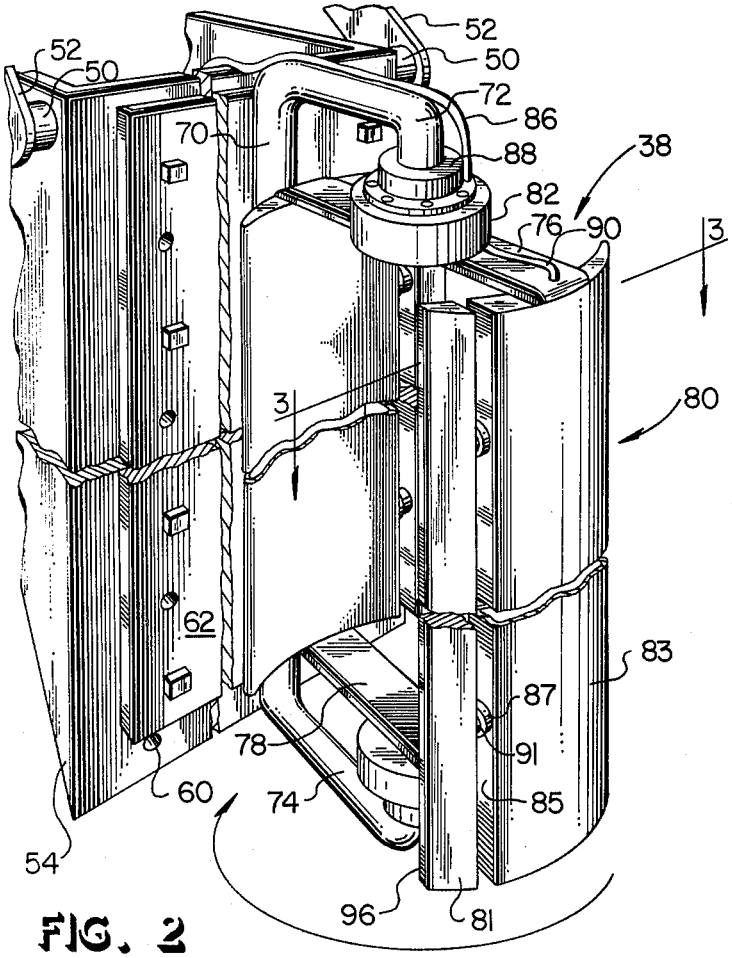
FIG. 2 is a perspective view of an acoustically driven ice cutting device.

Next referring to FIG. 2 of the drawings, the frame 54 is shown supporting the mounting plate 62 having upper and lower arm members 72, 74 extending outwardly therefrom to form a support for rotatably mounting the cutting device 38. Cutting device 38 is comprised of upper and lower frame members 76, 78 connected by cutting member 80. An electrically operated drive motor 82 is positioned on the upper frame member within the arms 72, 74. An acoustical transducer 84 (FIGS. 3&4) is mounted within the cutting member 80 and a tubular line 86 is shown extending from the frame 54 onto the upper transverse arm 72 for pivotal connection with the hydraulic swivel fitting 88 extending upwardly from the motor 82. Another hose 90 is shown passing through the motor housing for connection with the swivel fitting 88 to provide a fluid input to the acoustical transducer 84. (See FIG. 3).

Figure 3:
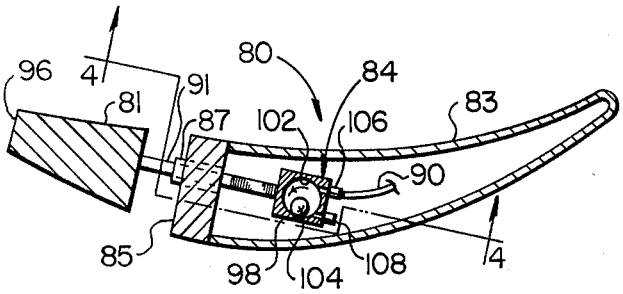
FIG. 3 is a cross-sectional plan view of the ice cutting device taken along lines 3—3 of FIG. 2.

FIG. 3 of the drawings shows a cross-sectional plan view of the cutting member 80 and transducer 84. The cutting member 80 is shown having a cutter bar or blade in a tapered configuration which is enlarged at its trailing edge and narrowing to a smaller blunt end 96 at its leading edge. Connecting rods 91 extend from the trailing end of the bar 81 and provide a means for holding the bar 81 in an extended fashion from the leading edge of a cutting member shroud 83 on the cutting member 80. An acoustical transducer 84, having a housing 98 with a cylindrical surface 102 formed therein, is positioned within the shroud 83 and is attached to connecting rods 91. A weighted rolling member 104 is positioned within the cylinder 102 and forms a rotor therein. Air input fitting 106 on the housing 98 provides a fluid communication path with cylinder 102. An exhaust fitting 108 is shown on the housing 98 to provide an exhaust path from the cylinder 102. Means, not shown, are provided for varying the fluid flow to the input fluid lines 86 and 90 to facilitate a variable operation of the transducer 84.

Figure 4:
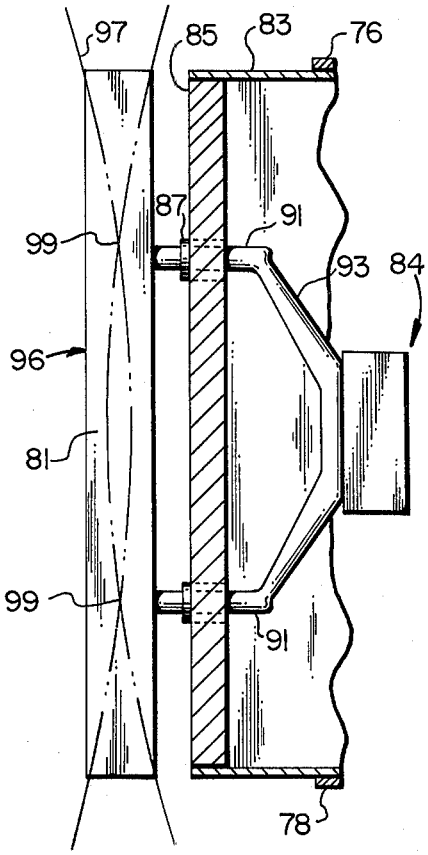
FIG. 4 is a partially cut away cross-sectional elevational view taken along lines 4—4 of FIG. 3.

FIG. 4 shows details of the manner in which the transducer 84 is mounted in the system to optimize the transmission of acoustical energy from the transducer to the bar 81. The connecting rods 91 which are attached to bar 81, are connected to a bifurcated bracket 93 which, in turn, is connected to the transducer 84. The shroud 83 which encloses the transducer has a front portion 85 with spaced openings for receiving a resilient lining material such as rubber, thus forming resilient sleeves 87. The sleeves 87 provide a resilient coupling between the rods 91 and shroud 83. The shroud, in turn, is connected to upper and lower frame members 76, 78.

The dotted lines 97 shown extending in a curve lengthwise of the bar 81, represent the acoustical standing waves which will be imparted to the bar as it is shaken or vibrated by the transducer 84 through the connecting rods 91 and bracket 93. The dotted lines cross at points 99 which crossing points represent nodes of the standing waves.

Figure 5:
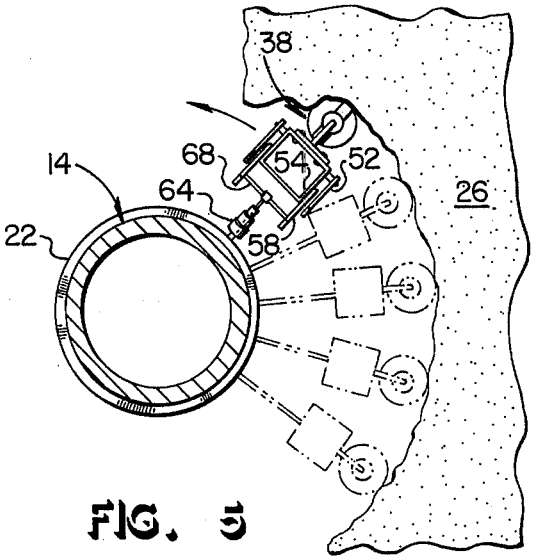
FIG. 5 is a plan view of an offshore platform support member in ice covered water showing a cutting mechanism clearing a path of unconsolidated ice for permitting relative movement of an ice floe to the support member.

Now referring to FIG. 5 of the drawings, support member 14 is shown in plan view positioned in a body of water and surrounded by an ice floe 26. The cutting device 38 is shown positioned at the end of boom 64 and in engagement with the ice. A series of ghosted images of the boom and cutting device are shown to represent a typical motion pattern of the cutting device in engaging a moving ice floe for deconsolidating the ice prior to its contacting the support member 14 as a consolidated floe.

In the operation of the ice apparatus described above, (first referring to FIGS. 1 and 5), as ice floe 26 moves toward the platform support member 14, it contacts cutting device 38. Cutting device 38 is positional about the periphery of the platform 12 by means of the crane and support mechanisms described above with respect to FIG. 1. More specifically, by actuation of the extendable boom 64, the cutting device may be positioned laterally away from the platform and vertically with respect to the ice water level surrounding the platform. For example, actuation of boom 64 in an outward direction would move the cutting device outwardly and upwardly relative to the platform. The cutter 38 may be raised and lowered by the bolting mounting plate 62 or by means of a remotely controlled mechanism (not shown) with respect to the water level. Pivotal mounting of these connected members permits their cooperative movement to position the cutting device in an infinite number of positions laterally and vertically with respect to the platform and support member. Likewise, the arrangement of the bridge crane 44 permits the peripheral movement of the entire cutting mechanism about the platform in order to accomodate the changes in direction of ice movement relative to the platform.

Referring again to FIG. 2 of the drawings, the cutting bars 81 of the cutting members 80 are arranged on opposite sides of the device so that they may be operated in tandem or singly depending on the type of cut desired in the ice. Moreover, if one of the cutting members is inoperable it may be removed for repair while the other is being used. In any event, a description of the operation of one of the cutting members will suffice for the purposes of describing the operation of the apparatus as set forth herein. A fluid power supply (not shown) is connected with the device by means of conduits 86 and 90 to provide a power source to the acoustical transducer 84. While the transducer may be operated by a fluid power supply, it is noted than an electrical motor could be used to power the transducer in which case the fluid supply and conduit would be replaced by an electrical power supply and lines. With reference to FIGS. 3 and 4, the transducer operates as follows: In its elemental form the transducer is basically a hollow cylinder with a weight inside which bears with centrifugal force against the wall of the cylinder as the weight is propelled around the cylinder with its center of gravity describing a closed path about the axis of the cylinder. The weight is in the form of the cylindrical rotor 104 and it rolls like a wheel on a race, the race being the machined inner surface of the enclosing hollow cylinder 102. The diameter of the rotor is typically only a little less than that of the cylinder which encloses it, and therefore, because their circumferences can be so near equal, only a partial turn of the rotor 104 can cause the pressure point of contact between rotor and race to travel a full 360°. The means for propelling the rotor within the cylinder is the fluid input and exhaust 106, 108 which may be either air or hydraulically operated to move the rotor within the cylinder. The exterior shape and size of the part of the resonant acoustical system that contains the hollow cylinder may be anything desired so long as it is big enough to contain the cylinder and the rotor is entirely free to roll in either direction but is constrained from moving endwise of the race and that propulsion of the rotor can be accomplished either by applying torque to turn it like a wheel about its own axis such as with an electrical motor, or by pushing it from without in a manner which would cause it to roll as by the application of air or hydraulic forces. The acoustical transducer shown, is in particular designed to provide a resonant system which in conjunction with the design of the cutter bar 81 provides the means for applying a directional force to the leading edge 96 of the cutting member and thereby maximizes the effect of the application of the acoustical energy to the ice floe. More typical mechanical vibrators may be used such as piezo electric or magnetic methods. However, these systems tend to be weak with respect to the amount of energy that can be provided to the work object. Devices such as a direct take off from an internal combustion free piston are too cumbersome and unmanageable as well as expensive to be considered. Mechanical vibrators, including the orbiting oscillator, which use some method of converting centrifugal force derived from revolving weights into alternating force may also be used. However, in such devices the force generated must be communicated through bearings which will be turning at a high speed and in the present case, operating in an environment which may be somewhat hostile with respect to long life of the mechanism. The orbiting oscillator device which is shown and described in this application circumvents this difficulty by transmitting its force through the exterior housing of the transducer, which is a non-moving part in the usual sense of the word, and therefore provides no problems with respect to friction, lubricating and cooling. From a dimension standpoint, the housing may be made as thick and strong as necessary. Also, it is possible to generate very large forces by the centrifugal method even with a comparatively small but high density weight, because force increases with the square of the frequency and therefore with the bearing problem eliminated, the present system becomes ideally suited for heavy duty acoustical application.

The force from the orbiting oscillator, because of its cyclical nature, is already an alternating force at any given point on the exterior body of the oscillator. The force is delivered in all directions, around a circle. It therefore remains to polarize the force into a coherent vibration back and forth along a straight line for most applications, making the force effective in the desired directions. This problem is self-solved when the orbiting oscillator is used as a component of a resonant system. In this respect the cutter bar 81 is so dimensioned and fabricated that it becomes really nothing more than a mass extension of the oscillator housing 89 and thus the entire assembly is a resonant bar. The bar itself without the transducer will have a resonant frequency and will produce characteristic standing waves if excited by acoustical energy. With the addition of the transducer, the nodes of standing waves will possibly be altered slightly, but in the configuration shown and described herein, that is, the elongated cutter bar 81, such a configuration will inherently resonate in the lateral or bending mode, and therefore utilize only the horizontal component of the rotary centrifugal force delivered by the oscillator. In all other directions appreciable motion is blocked by the large non-compliant mass of the total bar. Thus the motion of the bar which remains is in a horizontal plane transverse to the longitudinal axis of the bar and in a direction which imparts acoustical energy from the leading edge of the cutting bar into the encroaching side of the ice floe. Because of the non-compliant mass of the bar in other directions and the absence of motion in those directions, power is not consumed, because power is force distance per unit time, thus the oscillator is constrained by the resonant bar to spend its power producing horizontal motion only. In such a configuration, it is ideal to put power into the resonant system near its non-moving nodes which in the case of the cutting bar shown would tend to be nearer its upper and lower ends at points 99 as shown in FIG. 4. Therefore, it may be desirable to move the transducer upwardly or downwardly from the position shown in the drawing or change the arrangement of rods 91 and bracket 93 to more nearly correlate input of acoustic energy to the position of the nodes.

The only remaining important variable in operating the transducer system is timing. The oscillator frequency must match the natural resonant frequency of the system it is driving, in this case, the cutter bar 81. System frequency can, of course, be predetermined within reasonable limits by choice of materials and dimensioning. The oscillator output can be regulated by speed of propulsion. Work loads also very often bring about changes in resonant frequency which must be matched as they occur. In the case of an ice floe the density, salinity, temperature, etc., would affect the resonant frequency, thereby requiring a means for adjusting the oscillator output. If the rotor 104 goes around at a rate that matches the natural oscillations of the moving bar 81, the bar and oscillator are in phase and this is the precise frequency of peak resonance. It is also the exact frequency at which maximum power can be transmitted. If the imposed work load should happen to lower the system's resonance frequency a little, the element of unusable power will result in a speed up of the system which will allow it to proceed over the resonant frequency. In order to remedy this situation, the system should be operated at a frequency just below the peak of resonance in order to maintain stability. Therefore, a small amount of power above that being delivered to the system will always be needed to reach the peak. This method of operating an orbital oscillator is more precisely set forth in the report of the Bodine Sound Drive Company of 7877 Woodley Ave., Van Nuys, Calif. entitled "Report No. 189, Mar. 1, 1970, Orboresonance, the Technique of Heavy Duty Sonics".

It is believed that the removal of ice by use of the system described herein is efected as follows: In a typical acoustical vibration of the cutter, as energy from the tip of the cutter 96 is imparted into the face of ice, it sets up a compressive force into the ice. Ice being strong in compression simply compresses without breaking. As the cutter travels in the opposite direction, thus relaxing the force imposed on the ice on the inward stroke thereof, the ice is expanded outwardly by its own release of compressed energy and thus the ice is placed in tension, and being weak in tension, a small particle of the ice breaks away from the ice. Thus as the cutter is placed in juxtaposition to the ice, the alternating acoustical energy causes the ice to break away and if the cutter is moved relative thereto the cutter moves within the ice as if it were cutting butter, alleviating the necessity to impart direct mechanical force from the cutter to the ice. With respect to the theory of operation set forth above, there is no intention to be limited thereby concerning the breaking of ice subjected to acoustical energy.

As the cutting mechanism is rotated about its axis as shown in FIG. 5, it will cut an arc in the ice thus freeing arcuate segments of the ice as it moves transversely with respect to the face of a moving floe of ice. The entire mechanism is pivotally moved about the outer peripheral edge of the platform to cut a swath in the ice thereby causing fragments or arcuate segments to be cut which render the ice unconsolidated. Because of the relatively small size of ice segments with respect to the path being cut, the segments are allowed to pile up and be diverted downwardly or upwardly so that a solid ice front is not presented to the platform support 14. This allows the ice floe to move relative to the platform without imparting severe forces to the platform and its support structure which, in turn, permits the relative flow of ice with respect to the platform and maintenance of the platform in its fixed position over the subsurface bottom.

While particular embodiments of the present invention have been shown and described, it is apparent that changes and modifications may be made without departing from this invention in its broader aspects, and therefore, the aim in the appended claims is to cover all such changes and modifications that fall within the true spirit and scope of this invention.

What is claimed is:

1. A system for fragmenting ice about an offshore structure comprising:

A. means for directing acoustical energy into the ice, said energy directing means including:
   i. a transducer for generating acoustical energy;
   ii. an elongated beam adapted for engagement with the ice;
   iii. means for coupling said transducer to said beam such that acoustical energy generated by said transducer is transferred to said beam and is applied to the ice from said beam;

B. first support means for rotatably supporting said energy directing means such that said energy directing means may rotate about a first axis; and C. means for rotating said energy directing means about the first axis.

2. The system of claim 1 in which said coupling means is connected to said beam such that said beam vibrates in the bending mode.

3. The system of claim 2 wherein said coupling means is connected to said beam at first and second positions, said first position being proximate a first mode of said beam, said first node being located intermediate the center of said beam and a first end thereof, and said second position being proximate a second node of said beam, said second node being located intermediate the center of said beam and a second end thereof.

4. The system of claim 3 in which said coupling means is connected to said beam at said first and second nodes.

5. The system of claim 2 in which said transducer comprises an orbiting oscillator.

6. The system of claim 1 in which the offshore structure is supported on one or more legs, which system further includes second support means mounting said first support means for movement in a path entirely around at least one of said legs.

7. The system of claim 6 in which said second support means includes means for moving said first support means vertically and laterally with respect to said leg.

8. The system of claim 7 in which said second support means includes means for supporting said first support means for movement in an arcuate path.

* * * * *